US006970151B1

(12) United States Patent
Mosier

(10) Patent No.: US 6,970,151 B1
(45) Date of Patent: Nov. 29, 2005

(54) DISPLAY CONTROLLER WITH SPREAD-SPECTRUM TIMING TO MINIMIZE ELECTROMAGNETIC EMISSIONS

(75) Inventor: Donald E. Mosier, Cedar Rapids, IA (US)

(73) Assignee: Rockwell Collins, Cedar Rapids, IA (US)

( * ) Notice: Subject to any disclaimer, the term of this patent is extended or adjusted under 35 U.S.C. 154(b) by 875 days.

(21) Appl. No.: 09/654,306

(22) Filed: Sep. 1, 2000

(51) Int. Cl.[7] ..... G09G 5/00

(52) U.S. Cl. ..... 345/100; 345/87; 345/98; 345/204; 345/212; 345/213; 345/530; 315/85; 315/169.3; 327/551; 348/540

(58) Field of Search ..... 345/87, 98, 100, 345/204, 212, 213, 530, 440, 558; 315/85, 315/169.3; 327/551, 100; 348/540; 375/130

(56) References Cited

U.S. PATENT DOCUMENTS

| | | | | |
|---|---|---|---|---|
| 5,736,893 | A * | 4/1998 | Puckette et al. | 327/551 |
| 5,757,338 | A * | 5/1998 | Bassetti et al. | 345/3.2 |
| 5,977,961 | A * | 11/1999 | Rindal | 345/208 |
| 6,057,809 | A * | 5/2000 | Singhal et al. | 345/3.3 |
| 6,252,573 | B1 * | 6/2001 | Ito et al. | 345/100 |
| 6,377,646 | B1 * | 4/2002 | Sha | 375/376 |
| 6,456,281 | B1 * | 9/2002 | Rindal | 345/204 |

OTHER PUBLICATIONS

IEEE Catalog No. 94CH334702, Hardin, K.B. et al. Spread spectrum clock generation for the reduction of radiated emissions Electromagnetic Compatibility, 1994 Symposium Record, pp. 227i-231.*

* cited by examiner

*Primary Examiner*—Bipin Shalwala
*Assistant Examiner*—Vincent E. Kovalick
(74) *Attorney, Agent, or Firm*—Nathan O. Jensen; Kyle Eppele

(57) ABSTRACT

A display system is provided that reduces electromagnetic emissions of at least one frequency component of a signal in the display system. A signal that drives a display is modulated so that one or more frequency components of the driving signal are attenuated due to the modulation of the signal. In one embodiment, an LCD controller is adapted to provide a modulated row driving signal to an active matrix LCD. The input data source may be adapted to accommodate the modulated display driving signal. Alternatively, a FIFO buffer is used to buffer input data to accommodate the modulated display driving signal. In a further embodiment, a clock modulating circuit is provided to modulate the display driving signal without modifying the display controller. The display driving signal is a spread spectrum modulated version of a standard display driving signal wherein higher frequency components of the spread spectrum signal are attenuated compared to a non-modulated display driving signal without requiring filtering and without significantly reducing the driving signal frequency.

9 Claims, 3 Drawing Sheets

DISPLAY CONTROLLER WITH SPREAD-SPECTRUM TIMING TO MINIMIZE ELECTROMAGNETIC EMISSIONS

BACKGROUND

The present invention relates generally to the field of reducing electromagnetic emissions, and more specifically to reducing electromagnetic emissions in an LCD display or the like.

Active-matrix liquid-crystal displays (LCDs) and other similar displays with modulated back plane voltages radiate significant energy at harmonics of the modulation rate. For example, in an aviation environment having an avionics display, such emissions can adversely interfere with flight control and display functions, thereby creating a potential dangerous situation for crew and passengers. Attempts to combat this problem have generally involved either filtering the radiation through the addition of a transparent conductor over the display front that acts as an EMI shield, or minimizing the radiated energy by filtering the actual back plane modulation voltages. The transparent conductors are very costly, increase specular reflection, and require special conductive gaskets that are difficult to install, maintain, and test. Filtering the modulation voltages has limited effectiveness due to the need to drive a large capacitive load and the charge times imposed for proper LCD operation. Reducing the modulation frequency is beneficial, but is limited due to the visible optical changes it induces. In many devices, performance specification deviations are required.

SUMMARY

The present invention modifies the display drive timing for an LCD display or the like such as utilized in an aviation environment as an avionics display to modulate the duration of the refresh time for rows of the display. Since back plane modulation occurs on multiples of row time, the present invention modulates the frequency of back plane modulation. Modulating the frequency of the back plane modulation spreads the spectrum of the radiated energy, particularly for higher harmonics (i.e., frequency components) where such systems typically fail to meet predetermined requirements. In one embodiment, the invention includes a means for controlling a display and a means for buffering input data received from a data source provided to the controlling means. The controlling means is adapted to provide a modulated driving signal to the display wherein at least one frequency component of the modulated driving signal is attenuated by the modulation such that emanated electromagnetic emissions are reduced. In another embodiment, the invention includes a means for controlling a display and a means for providing input data to be displayed in the display to the controlling means. The controlling means is adapted to provide a modulated driving signal to the display wherein at least one frequency component of the modulated driving signal is attenuated by the modulation such that emanated electromagnetic emissions are reduced. The input data providing means is similarly adapted to provide a modulated input data signal to the controlling means to accommodate the modulated driving signal provided by the controlling means to the display. In a further embodiment, the invention includes a means for controlling a display and a means for causing the controlling means to provide a modulated driving signal to the display wherein at least one frequency component of the modulated driving signal is attenuated by the modulation such that emanated electromagnetic emissions are reduced. In a particular embodiment, the causing means is a circuit for modulating a signal provided to the controlling means.

BRIEF DESCRIPTION OF THE DRAWINGS

The numerous advantages of the present invention may be better understood by those skilled in the art by reference to the accompanying figures in which.

DETAILED DESCRIPTION

Reference will now be made in detail to several embodiments of the invention, examples of which are illustrated in the accompanying drawings.

Figure 1:
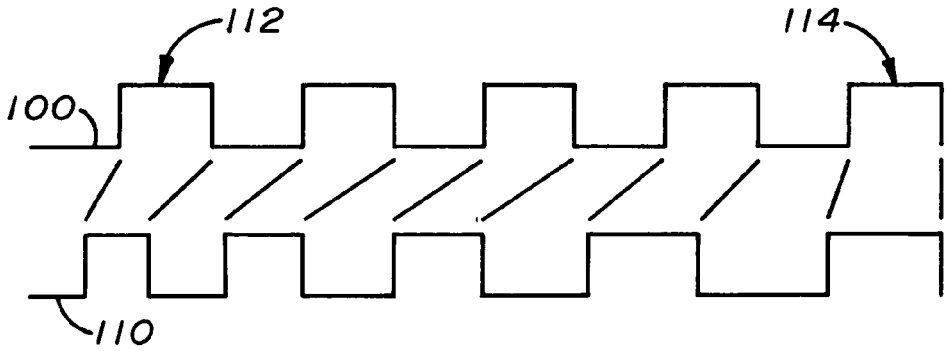
FIG. 1 is a diagram of a desired spread spectrum waveform compared to a standard display driving waveform in accordance with the present invention.

Referring now to FIG. 1, plots of waveforms for driving a display in accordance with the present invention will be discussed. A standard waveform for driving a typical liquid-crystal display (LCD) is shown at 100 in which the magnitude of the signal is plotted with respect to time. Such a standard waveform 100 is typically a digital signal generally having a square wave pattern of a fixed frequency. The standard waveform 100 is utilized in an LCD controller and display system, for example as a signal to drive the refreshing of row data displayed on an LCD. A spread spectrum waveform in accordance with the present invention is shown at 110. Spread spectrum waveform 110 is substantially similar to standard waveform 100; however, rather than having a fixed frequency, spread spectrum waveform 110 has a frequency that varies over time according to a predetermined modulation. As shown by example in FIG. 1, the frequency of spread spectrum waveform 110 is higher earlier in time and changes to a lower frequency later in time. It should be noted that, although not shown in FIG. 1, the frequency of spread spectrum waveform 110 may alternatively be modulated to start at a lower frequency earlier in time and change to a higher frequency later in time, and may also vary according to one of several known spread spectrum modulation techniques. As can be seen in FIG. 1, corresponding high signal values of standard waveform 100 and spread spectrum 110 waveform are shown. Earlier in time, the high period of spread spectrum waveform 110 is lower than that of standard waveform 100 for a corresponding high signal value such as shown at high period 112, and later in time the high period of spread spectrum waveform 110 is greater than that of standard waveform 100. Thus, in accordance with the present invention, the frequency of the row refresh signal is modulated to change over time with respect to a standard row refresh signal to provide a spread spectrum row refresh signal.

Figure 2:
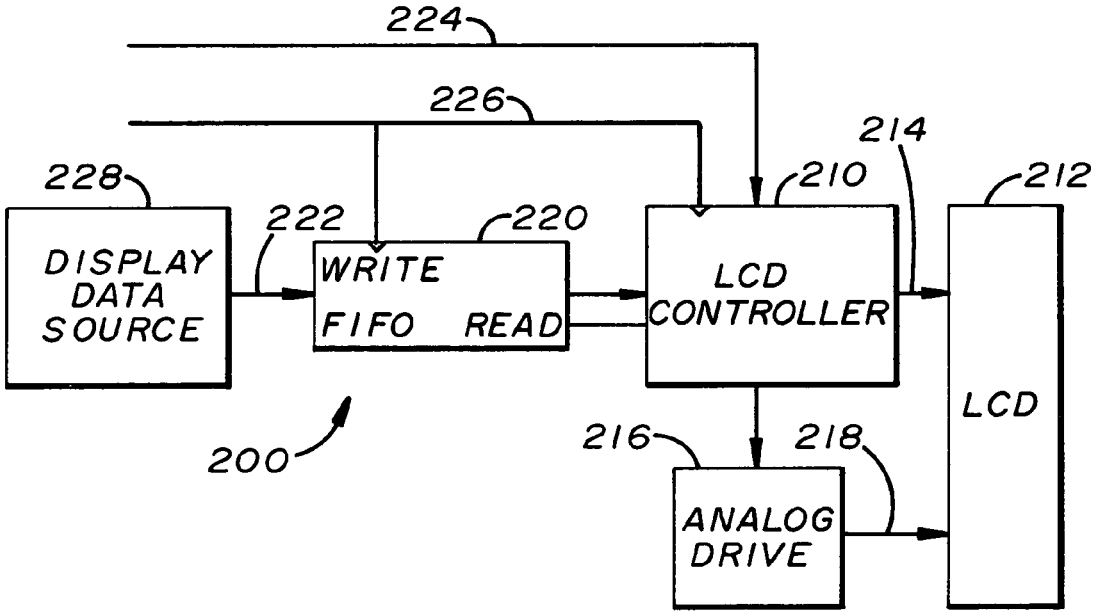
FIG. 2 is a block diagram of a display system in accordance with the present invention.

Referring now to FIG. 2, a block diagram of an LCD controller for driving a liquid-crystal display in accordance with the present invention will be discussed. In display system 200, an LCD controller 210 provides data and control signals to a liquid-crystal display (LCD) 212 at line 214. LCD controller 210 also controls an analog drive circuit 216 that provides analog signals to LCD at line 218. Pixel input data to be displayed on LCD 212 is provided to LCD controller 210 from a display data source 228 via an optional first-in, first-out (FIFO) buffer on input line 222. Vertical sync data is provided to LCD controller 210 via line 224, and a pixel clock signal drives LCD controller 210 and buffer 220 via clock line 226. In accordance with one embodiment of the present invention, LCD controller 210 is internally modified to provide variable row timing such that multiple frequencies are included in the row signal spectrum. To prevent the total refresh time from varying relative to the availability of data, and to prevent the loss of refresh data, modulation of the row timing signal is provided in both directions in time with respect to a nominal row time. For example, if a typical display is refreshed at 61.33 Hz and a total of 800 row times constitute a refresh cycle, for example with 768 display rows and a vertical sync signal with a 32 row time duration, the nominal row time is 20.38 microseconds or 509.5 periods of a 25 MHz clock. In order to maintain a lock with the input data, LCD controller 210 varies the row time about the nominal row time of 20.38 microseconds such that the row time is spread from 20.0 microseconds, or 500 clocks, to 20.76 microseconds, or 519 clocks. An example distribution of row times is shown in Table 1, below.

TABLE 1

Typical Row Time Distribution (Input Clock 25 MHz)

| Display Row No. | Clocks/Row | Row Time (μs) | Effective Frequency (kHz) |
|---|---|---|---|
| 0–3 | 500 | 20.00 | 12.500 |
| 4–7 | 501 | 20.04 | 12.475 |
| 8–11 | 502 | 20.08 | 12.450 |
| . . . | . . . | . . . | . . . |
| 72–75 | 518 | 20.72 | 12.065 |
| 76–79 | 519 | 20.26 | 12.042 |
| 80–83 | 500 | 20.00 | 12.500 |
| 84–87 | 501 | 20.04 | 12.475 |
| . . . | . . . | . . . | . . . |

Since the actual display refresh time becomes asynchronous from the input data, an optional FIFO buffer 220 is utilized to provide data buffering during times when LCD controller 210 is lagging behind the input data received at line 222. Since LCD controller 210 generally cannot get ahead of the input data, in one embodiment the sweep of the row starts at lower frequencies and ends at higher frequencies. In an alternative embodiment of the present invention, the display data source 228 that provides input data at line 222 is modified to accommodate the spread of the row refresh signal by modulating the display input data such that FIFO buffer 220 would not be used. Liquid-crystal display 212 of FIG. 2 in one embodiment of the invention is an avionics display utilized in an avionics environment. Although one particular embodiment of the invention provides a display system 200 for controlling an LCD 212, the display controlled by display system 200 need not be a liquid-crystal display. Display system 200 may be utilized with any suitable type of display, for example, cathode-ray tube, gas plasma, field-emission panel, spatial light modulator, etc., that have a similar emission as LCD display 212 as discussed herein that may be attenuated or eliminated by utilization of display system 200 in accordance with the present invention, without departing from the scope of the present invention and without providing substantial change thereto.

Figure 3:
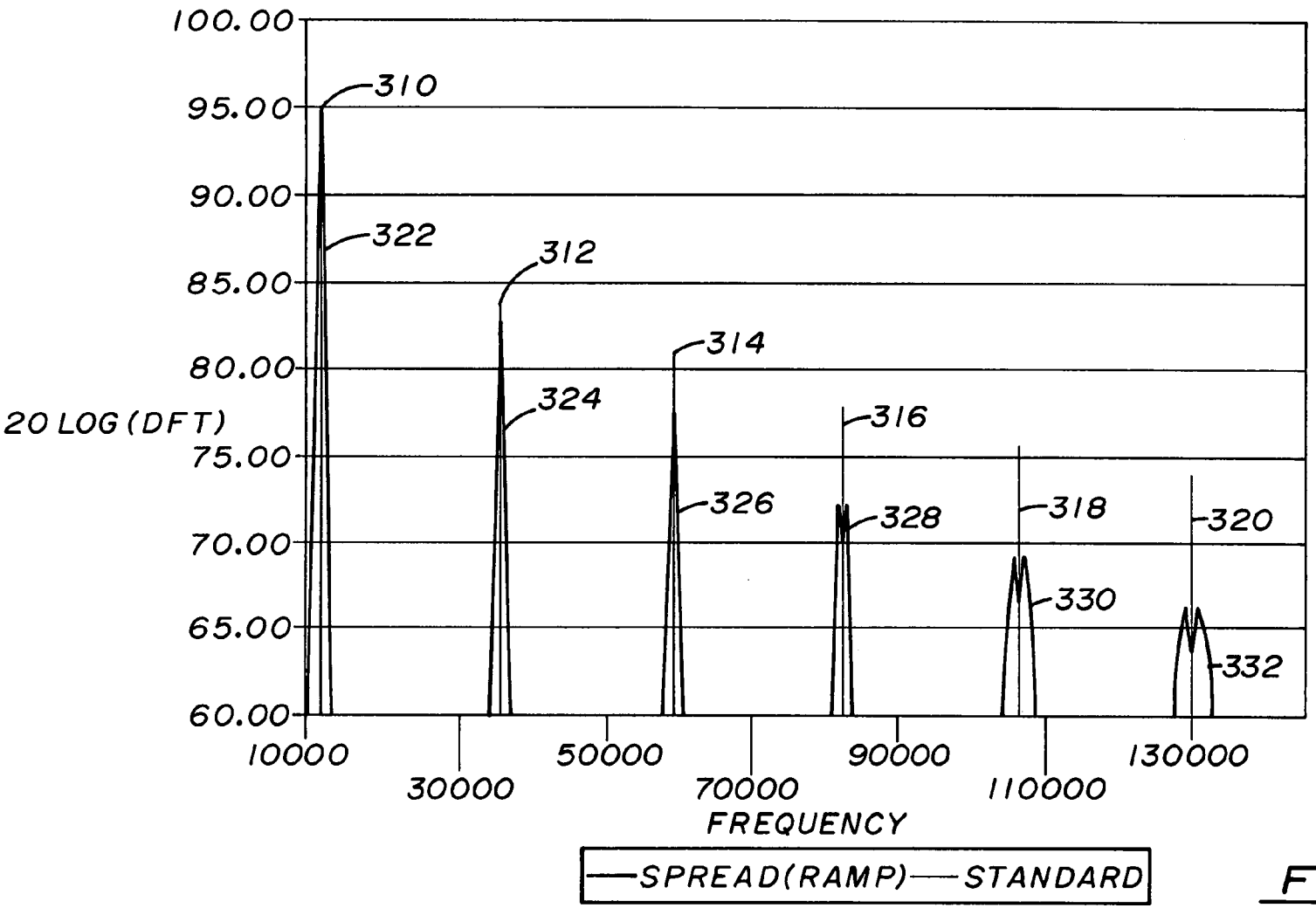
FIG. 3 is a diagram of a frequency component magnitude comparison between a typical LCD system and a system in accordance with the present invention.

Referring now to FIG. 3, a plot of the electromagnetic emissions of an LCD controller in accordance with the present invention will be discussed. Frequency components of the discrete Fourier transform (DFT) of standard waveform 100 are shown at 310, 312, 314, 316, 318, and 320 that occur at approximately 12 kHz, 36 kHz, 60 kHz, 84 kHz, 108 kHz, and 132 kHz, respectively. Frequency components of the discrete Fourier transform (DFT) of spread spectrum waveform 110 in accordance with the present invention are shown at 322, 324, 326, 328, 330, and 332 centered at approximately the same center frequency as the corresponding frequency components of standard waveform 100. As can be seen in FIG. 3, the peak magnitudes of the frequency components 322–332 of spread spectrum waveform 110 are less than the peak magnitudes of the frequency components 310–320 of standard waveform 100 due to the spreading of standard waveform 100 across multiple frequencies about the nominal frequency of standard waveform 100 that results in spread spectrum waveform 110. The frequency components 322–332 of spread spectrum waveform 110 exhibit an attenuation with increasing frequency that is analogous to the roll-off characteristics that would be exhibited if standard waveform 100 were passed through a low-pass filter. However, the attenuation characteristics of spread spectrum waveform 110 as shown in FIG. 3 are achieved via spreading of standard waveform 100 about the nominal standard waveform frequency without requiring any filtering circuitry or techniques. It can be seen from FIG. 3 that the electromagnetic emissions emanated from a display due to a spread spectrum modulated display driving signal are reduced in comparison to a standard display driving signal.

Figure 4:
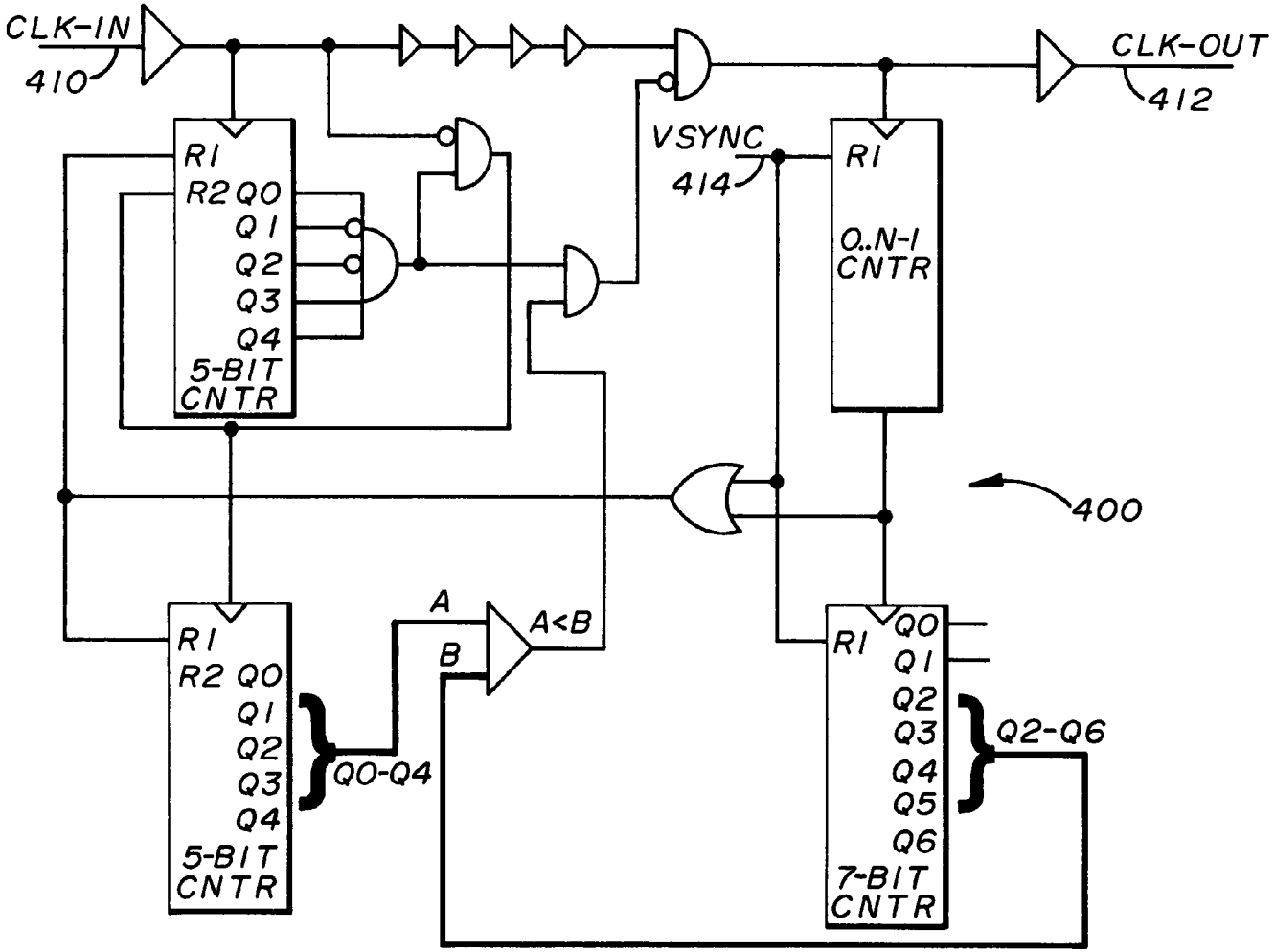
FIG. 4 is a block diagram of a circuit capable of modulating the driving voltages of a display in accordance with the present invention without requiring modification of a preexisting display controller.

Referring now to FIG. 4, a circuit for modulating the clock signal of a standard LCD controller to provide a spread spectrum signal in accordance with the present invention will be discussed. As an alternative to providing a modified LCD controller 210, circuit 400 may be interposed between a clock (not shown) of display system 200 and a clock input of LCD controller 210 so that the spreading of the clock signal may be accomplished in accordance with the present invention without modifying LCD controller 210. For example, clock line 226 is broken and circuit 400 is inserted at the break at clock input 410 and clock output 412. Vertical sync data from line 224 is provided to circuit 400 at input 414. Circuit 400 uses a configuration of counters and logic gates to cause the frequency of a fixed clock signal such as standard waveform 100 to have a varying frequency to arrive at spread spectrum waveform 110. Although one particular configuration of circuit 400 is shown in FIG. 4, one having skill in the art after having read the present disclosure would appreciate that other configurations of circuit 400, analog or digital, or any combination thereof, could be provided without providing substantial change to the scope of the invention, to accomplish the same or substantially the same function and result achieved with circuit 400.

It is believed that the display controller with spread-spectrum timing to minimize electromagnetic emissions of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. An apparatus, comprising:

means for controlling an avionics display; and means for buffering input data received from a data source provided to said controlling means;

said controlling means being adapted to provide a modulated row driving signal to the display, wherein at least one frequency component of the modulated row driving signal is attenuated by the modulation such that emanated electromagnetic emissions are reduced, wherein the modulated row driving signal has a different period for one row than for another row.

2. An apparatus as claimed in claim 1, the modulated row driving signal provided by said controlling means being a spread spectrum modulating signal.

3. An apparatus as claimed in claim 1, said controlling means comprising a controller structure.

4. An apparatus as claimed in claim 1, said buffering means comprising a memory structure.

5. An apparatus as claimed in claim 1, said buffering means comprising a FIFO memory structure.

6. An apparatus as claimed in claim 1, said controlling means comprising a controller structure, said buffering means comprising a FIFO memory structure, and the modulated row driving signal provided by the controller structure being a spread spectrum signal.

7. An apparatus, comprising:

means for controlling an avionics display; and means for providing input data to be displayed in the display to said controlling means;

said controlling means being adapted to provide a modulated row driving signal to the display wherein at least one frequency component of the modulated row driving signal is attenuated by the modulation such that emanated electromagnetic emissions are reduced, said input data providing means being adapted to provide a modulated input data signal to said controlling means to accommodate the modulated row driving signal provided by said controlling means to the display, the modulated row driving signal having a first period for a first row, and a second period for a second row.

8. An apparatus as claimed in claim 7, the modulated row driving signal provided by said controlling means being a spread spectrum signal.

9. An apparatus as claimed in claim 7, said controlling means comprising a controller structure.

* * * * *